US007916112B2

(12) United States Patent
Peng et al.

(10) Patent No.: US 7,916,112 B2
(45) Date of Patent: Mar. 29, 2011

(54) SYSTEMS FOR CONTROLLING PIXELS

(75) Inventors: Du-Zen Peng, Jhubei (TW); Shih-Chang Chang, Jhudong Township, Hsinchu County (TW)

(73) Assignee: TPO Displays Corp., Maio-Li County (TW)

( * ) Notice: Subject to any disclaimer, the term of this patent is extended or adjusted under 35 U.S.C. 154(b) by 1232 days.

(21) Appl. No.: 11/253,374

(22) Filed: Oct. 19, 2005

(65) Prior Publication Data

US 2007/0085780 A1 Apr. 19, 2007

(51) Int. Cl.
*G09G 3/30* (2006.01)

(52) U.S. Cl. ..... 345/100; 345/76

(58) Field of Classification Search ..... 345/76, 345/77, 690, 100; 315/169.3
See application file for complete search history.

(56) References Cited

U.S. PATENT DOCUMENTS

| | | | | |
|---|---|---|---|---|
| 6,069,598 | A | 5/2000 | Hansen | |
| 6,282,149 | B1 * | 8/2001 | Pittau | 365/233.14 |
| 6,583,775 | B1 | 6/2003 | Sekiya et al. | 345/76 |
| 6,686,699 | B2 | 2/2004 | Yumoto | 315/169.3 |
| 6,859,193 | B1 | 2/2005 | Yumoto | 345/82 |
| 2003/0020335 | A1 | 1/2003 | Komiya | |
| 2003/0089474 | A1 | 5/2003 | Zwick et al. | |
| 2003/0227262 | A1 | 12/2003 | Kwon | |
| 2005/0116656 | A1 | 6/2005 | Shin | 315/169.3 |
| 2006/0066525 | A1 * | 3/2006 | Childs | 345/76 |
| 2007/0262928 | A1 * | 11/2007 | Steer et al. | 345/76 |

FOREIGN PATENT DOCUMENTS

| | | | |
|---|---|---|---|
| EP | 597772 | A1 * | 5/1994 |
| EP | 1061497 | | 12/2000 |
| EP | 1061497 | A1 * | 12/2000 |
| EP | 1600924 | | 11/2005 |
| EP | 0597772 | | 10/2008 |
| JP | 2006-184871 | | 7/2006 |
| WO | WO2005036515 | | 4/2005 |

OTHER PUBLICATIONS

EP Communication of EP Corresponding patent application mailed Jul. 23, 2008.
English Abstract of EP0597772.
English Abstract of EP1600924.
EP Search Report mailed Mar. 21, 2006.
European Office Action date Jun. 17, 2010.
Japanese language office action dated May 11, 2010.
English language translation of abstract of JP 2006-184871 (published Jul. 13, 2006).

* cited by examiner

*Primary Examiner* — Amare Mengistu
*Assistant Examiner* — Jennifer Zubajlo
(74) *Attorney, Agent, or Firm* — Thomas|Kayden

(57) ABSTRACT

Systems for controlling pixels are provided. A representative system comprises a scan driver comprises: a data signal line operative to provide data to the pixel; and a scan driver operative to control illumination of the pixel during sequential time periods such that, if data provided by the data signal line is different between a first time period and a second time period, brightness of the pixel differs during a third time period and a sequential fourth time period. The pixel is illuminated during the third time period and the fourth time period.

15 Claims, 7 Drawing Sheets

SYSTEMS FOR CONTROLLING PIXELS

BACKGROUND

The disclosure relates to display devices.

Electroluminescence (EL) display devices include organic light emitting diode (OLED) displays and polymeric light emitting diode (PLED) displays. In accordance with associated driving methods, an OLED can be an active matrix type or a positive matrix type. An active matrix OLED (AM-OLED) display typically is thin and exhibits lightweight characteristics, spontaneous luminescence with high luminance efficiency and low driving voltage. Additionally, an AM-OLED display provides the perceived advantages of increased viewing angle, high contrast, high-response speed, full color and flexibility.

An AM-OLED display is driven by electric current. Specifically, each of the matrix-array pixel areas of an AM-OLED display includes at least one thin film transistor (TFT), serving as a driving TFT, to modulate the driving current. Driving current is modulated based on the variation of capacitor storage potential to control the brightness and gray level of the pixel areas.

The gray level is selected by using a voltage divider comprising resistors. FIG. 1*a* is a schematic diagram of a conventional voltage divider. The voltage divider 10 comprises resistors serially connected between a high voltage source (Vcc) and a low voltage source (Gnd). Each point between two resistors has a corresponding voltage indicating a particular gray level.

A point 110 of voltage divider 10 can provide a maximum gray level indicating a maximum brightness of the AM-OLED. Since a voltage divider only provides one maximum gray level, if a user desires to adjust the maximum brightness of the AM-OLED higher, the AM-OLED requires several voltage dividers.

FIG. 1*b* is a schematic diagram of another conventional voltage divider. A voltage between two resistors can be adjusted according to the resistance of two resistors. In this case, a first maximum gray level provided by voltage divider 10 is 100 nits, a second maximum gray level provided by voltage divider 12 is 150 nits, and a third maximum gray level provided by voltage divider 14 is 200 nits. Therefore, the brightness of the AM-OLED can be adjusted by providing different maximum gray levels; however, the cost and volume of the AM-OLED are increased.

SUMMARY

Systems for controlling pixels are provided. An exemplary embodiment of such a system comprises a scan driver comprising: a first shift-register unit operative to output a first shift signal according to a first start signal; a second shift-register unit operative to output a second shift signal according to the first shift signal for lighting the first pixel; a third shift-register unit operative to output a third shift signal according to the second shift signal; and a first processor operative to control the first pixel to receive the first data signal according to the first, the second, and the third shift signals. A duty cycle of the first start signal determines a light-emitting duration of the first pixel.

Another embodiment of a system for controlling a pixel comprises: a data signal line operative to provide data to the pixel; and a scan driver operative to control illumination of the pixel during sequential time periods such that, if data provided by the data signal line is different between a first time period and a second time period, brightness of the pixel differs during a third time period and a sequential fourth time period. The pixel is illuminated during the third time period and the fourth time period.

Another embodiment of a system for controlling a pixel comprises a display device. The display device comprises a display panel comprising a first pixel; an EL driver operative to output a start signal; a data driver operative to output a first data signal to the first pixel; and a scan driver operative to output a first scan signal and a second scan signal to the first pixel. The first pixel is operative to receive the first data signal according to the first scan signal and the first pixel is illuminated according to the second scan signal. The scan driver comprises: a first shift-register unit operative to output a first shift signal according to the first start signal; a second shift-register unit operative to output a second shift signal according to the first shift signal for lighting the first pixel; a third shift-register unit operative to output a third shift signal according to the second shift signal; and a first processor operative to control the first pixel to receive the first data signal according to the first, the second, and the third shift signals. A duty cycle of the first start signal establishes a light-emitting duration of the first pixel.

BRIEF DESCRIPTION OF THE DRAWINGS

The invention can be more fully understood by reading the subsequent detailed description and examples with reference made to the accompanying drawings, wherein.

DETAILED DESCRIPTION

Figure 1B:
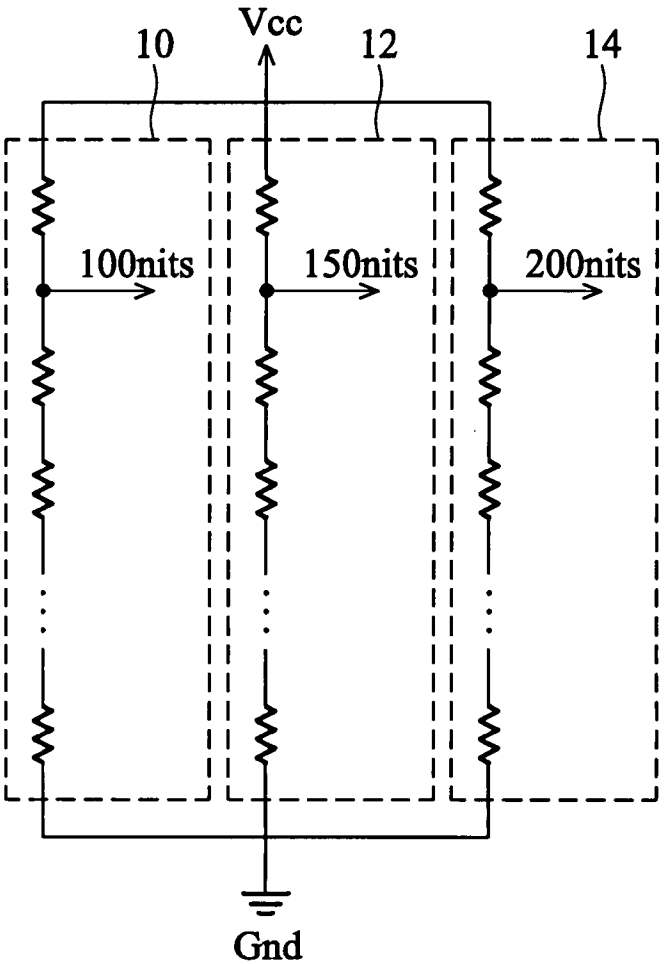
FIG. 1b (RELATED ART)
FIG. 1*b* is a schematic diagram of another conventional voltage divider.
Figure 1A:
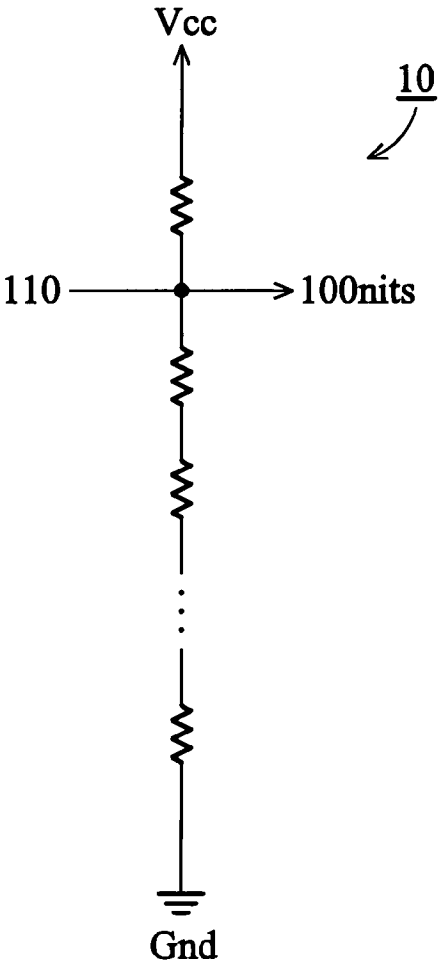
FIG. 1a (RELATED ART)
FIG. 1*a* is a schematic diagram of a conventional voltage divider.
Figure 2A:
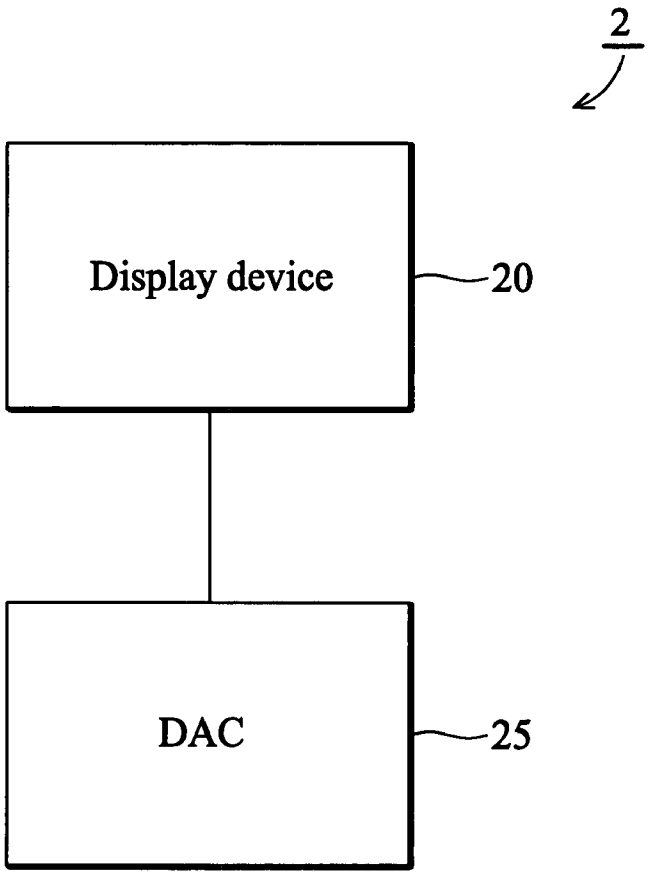
FIG. 2*a* is a schematic diagram of an embodiment of a system for controlling pixels.

Systems for controlling pixels are provided. As will be described with reference to several exemplary embodiments, brightness of the pixels of a display can be adjusted, such as by increasing the light-emitting duration of the pixels. In this regard, FIG. 2*a* is a schematic diagram of an embodiment of a system for controlling pixels that is implemented as an electronic device. Note that such an electronic device can be provided in various configurations, such as a PDA, a display monitor, a notebook computer, a tablet computer, or a cellular phone. Electronic device 2 comprises a display device 20 and a digital-to-analog converter (DAC) 25. DAC 25 supplies power to display device 20.

Figure 2B:
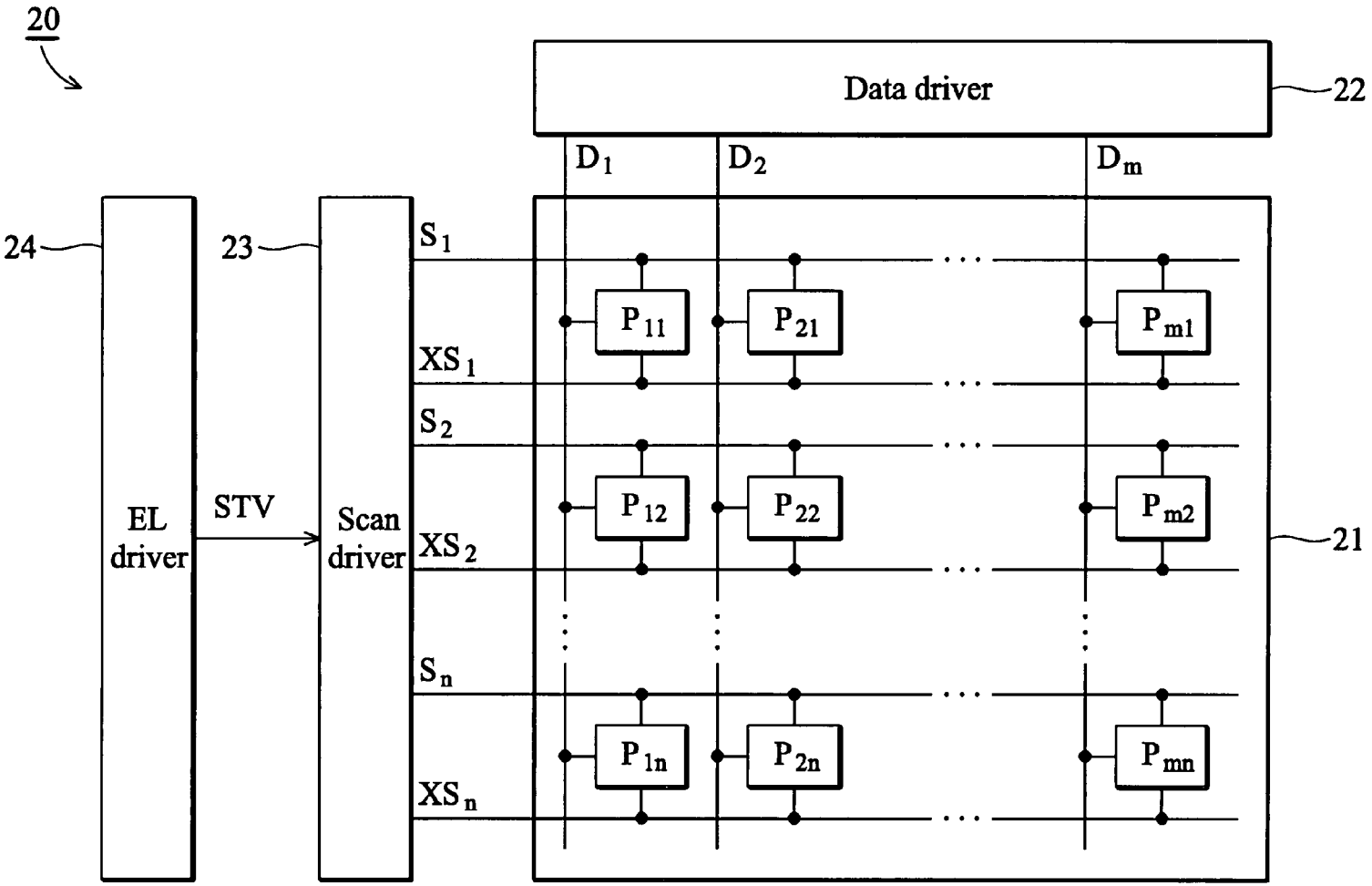
FIG. 2*b* is a schematic diagram of an embodiment of a display device used in the system of FIG. 2*a;*

FIG. 2*b* is a schematic diagram of an embodiment of display device 20. As shown in FIG. 2*b*, display device 20 comprises a display panel 21 comprising pixels $P_{11}$~$P_{mn}$, a data driver 22, a scan driver 23, and an electroluminescence (EL) driver 24, which can be implemented by an integrated circuit (IC).

Data driver 22 provides data signals $D_1$~$D_m$ to pixels $P_{11}$~$P_{mn}$. Scan driver 23 receives a start signal (STV) output from EL driver 24 and controls pixels $P_{11}$~$P_{mn}$ by scan signals $S_1$~$S_n$ and $XS_1$~$XS_n$. Pixels $P_{11}$~$P_{mn}$ receive data signals $D_1$~$D_m$ according to scan signals $S_1$~$S_n$ and pixels $P_{11}$~$P_{mn}$ are illuminated according to scan signals $XS_1$~$XS_n$.

Figure 3:
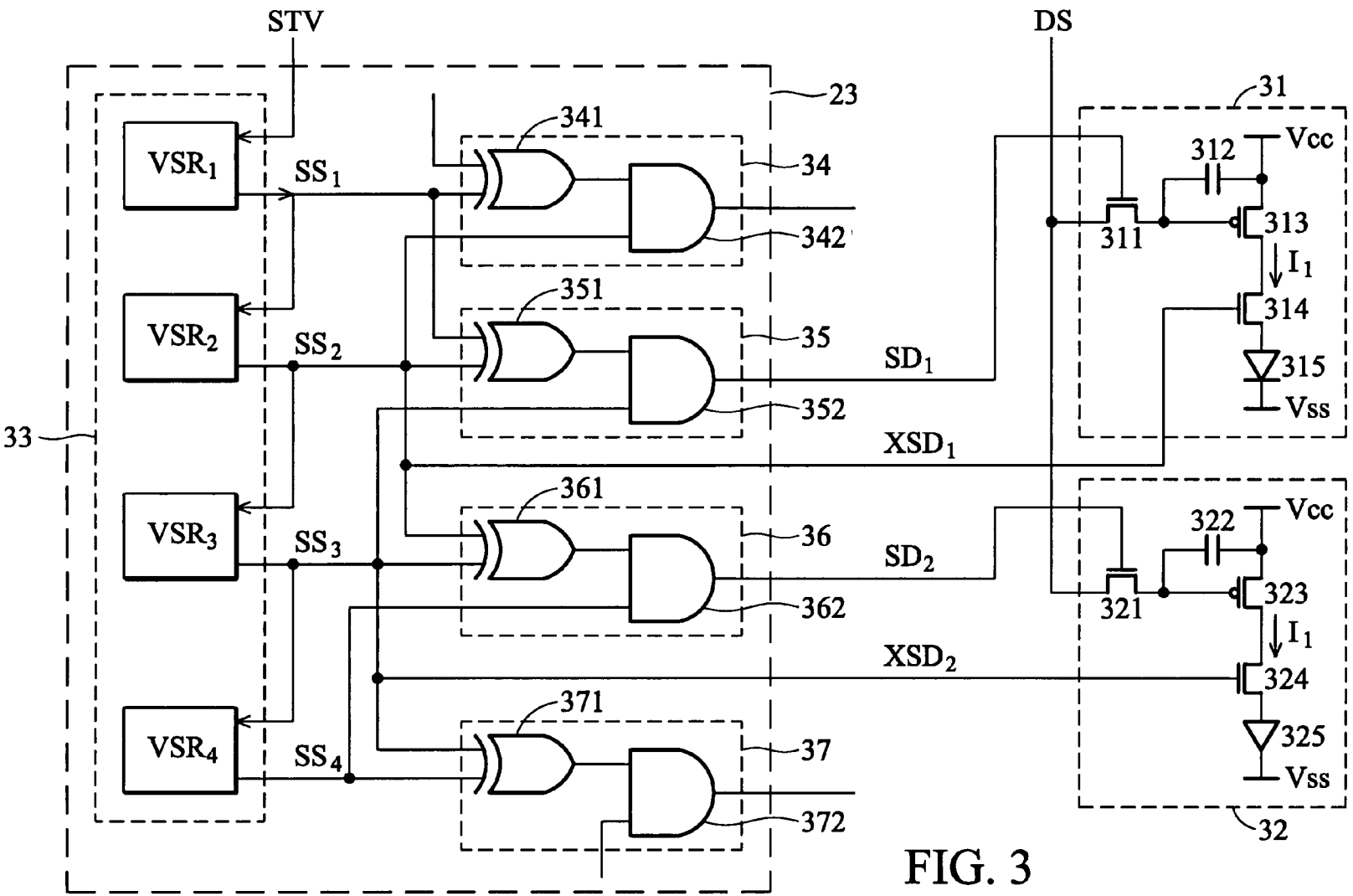
FIG. 3 is a schematic diagram of an embodiment of a scan driver.

FIG. 3 is a schematic diagram of an embodiment of a scan driver. For clarity, only two pixels of the display are shown. The structures of the pixels shown in FIG. 3 are given as an example; however, in other embodiments, other configurations can be used.

Scan driver 23 comprises a shift register circuit 33 and processors 34~37. Shift register circuit 33 comprises shift register units $VSR_1$~$VSR_4$. Each shift register unit outputs a shift signal according to a duty cycle of start signal STV.

Processor 34 comprises logic units 341 and 342. A first input terminal of logic unit 341 is floating and a second input terminal of logic unit 341 receives shift signal $SS_1$. A first input terminal of logic unit 342 is coupled to an output terminal of logic unit 341 and a second input terminal of logic unit 342 receives shift signal $SS_2$. Since the first input terminal of logic unit 341 is floating, an output terminal of logic unit 342 does not control a pixel. Processor 35 comprises logic units 351 and 352. Logic unit 351 receives shift signals $SS_1$ and $SS_2$. Logic unit 352 receives an output signal of logic unit 351 and shift signal $SS_3$ to generate scan signal $SD_1$. Pixel 31 receives data signal DS according to scan signal $SD_1$. Shift signal $SS_2$ also corresponds to scan signals $XSD_1$. Pixel 31 is illuminated according to scan signal $XSD_1$.

Processor 36 comprises logic units 361 and 362. Logic unit 361 receives shift signals $SS_2$ and $SS_3$. Logic unit 362 receives an output signal of logic unit 361 and shift signal $SS_4$ to generate scan signal $SD_2$. Pixel 32 receives data signal DS according to scan signal $SD_2$. Shift signal $SS_3$ corresponds to scan signals $XSD_2$. Pixel 32 is illuminated according to scan signal $XSD_2$.

Processor 37 comprises logic units 371 and 372. Logic unit 371 receives shift signals $SS_3$ and $SS_4$. A first input terminal of logic unit 372 receives an output signal of logic unit 371 and a second input terminal of logic unit 372 is floating. Since the second input terminal of logic unit 372 is floating, an output terminal of logic unit 372 does not control a pixel.

In this embodiment, logic units 341, 351, 361, and 371 are XOR gates and logic units 342, 352, 362, and 372 are AND gates.

Figure 4:
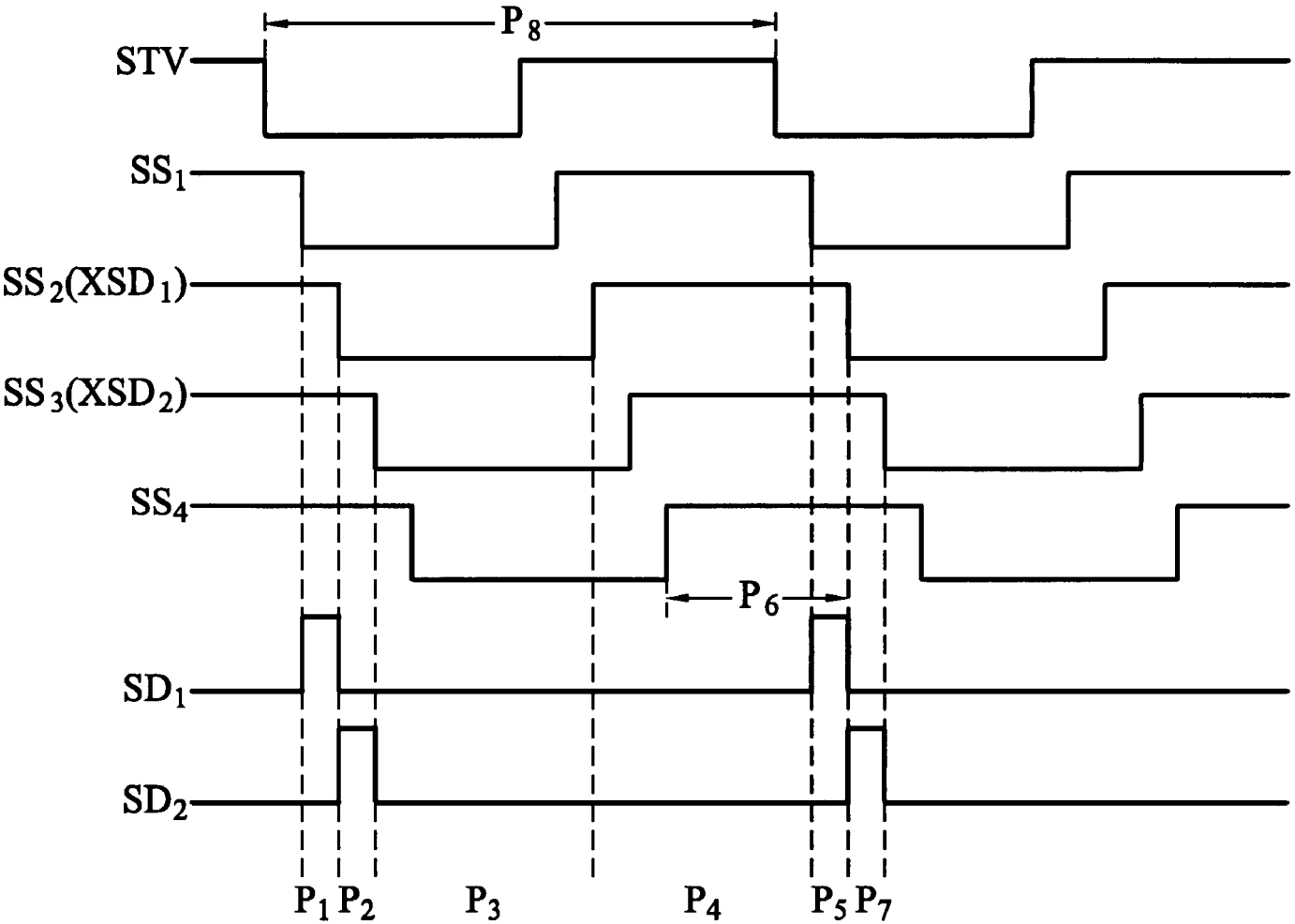
FIG. 4 is a timing diagram of the scan driver of FIG. 3.

FIG. 4 is a timing diagram of the embodiment of the scan driver depicted in FIG. 3. In FIG. 3, shift register units $VSR_1$~$VSR_4$, respectively, output shift signals $SS_1$~$SS_4$ responsive to shift register unit $VSR_1$ receiving start signal STV.

Pixel 31 receives data signal DS according to shift signals $SS_1$~$SS_3$ received by processor 35. As shown in FIG. 4, a logic level of shift signal $SS_1$ is low and those of shift signals $SS_2$ and $SS_3$ are high such that a logic level of scan signal $SD_1$ is high in period $P_1$.

Therefore, transistor 311 can be turned on. A data signal is transmitted to capacitor 312 through transistor 311 to charge capacitor 312. Transistor 313 is turned on for outputting driving current $I_1$ as a voltage of capacitor 312 reaches a first preset value. Since a logic level of scan signal $XSD_1$ is high, transistor 314 is turned on in period $P_1$. Light-emitting element 315 is illuminated as driving current $I_1$ is transmitted to light-emitting element 315 by transistor 314.

In period $P_2$, the logic level of scan signal $XSD_1$ is low such that light-emitting element 315 is extinguished. Since the logic level of scan signal $SD_2$ is high, capacitor 322 is charged such that driving current $I_2$ is provided by transistor 323. Light-emitting element 325 receives driving current $I_2$ and is illuminated as the logic level of scan signal $SD_2$ is high.

In period $P_3$, the logic level of scan signal $XSD_2$ is low such that light-emitting element 325 is extinguished. In period $P_4$, the logic level of scan signal $XSD_1$ is high such that transistor 314 is turned on. Since the voltage of capacitor 312 maintains the first preset value, transistor 313 generates driving current $I_1$, which is provided to light-emitting element 315 for illustrating that element.

In period $P_5$, since the logic level of scan signal $SD_1$ is high, capacitor 312 is again charged according to data signal DS such that the voltage of capacitor 312 reaches a second preset value. Transistor 313 generates new driving current $I_1$ according to the new voltage of capacitor 312. Since the logic level of scan signal $XSD_1$ is also high, light-emitting element 315 is illuminated.

In period $P_4$, the voltage of capacitor 312 depends on the data signal DS received by transistor 311 in period $P_1$. In period $P_5$, the voltage of capacitor 312 depends on the data signal DS received by transistor 311 in period $P_5$. Although light-emitting element 315 is illuminated in periods $P_4$ and $P_5$, if data signal DS in period $P_1$ is different than the data signal DS in period $P_5$, the brightness of light-emitting element 315 in period $P_4$ differs from the brightness of light-emitting element 315 in period $P_5$.

In period $P_6$, the logic level of scan signal $XSD_2$ is high such that transistor 324 is turned on. Since the voltage of capacitor 322 can turn on transistor 323, light-emitting element 325 receives driving current $I_2$ and is illuminated.

In period $P_7$; since the logic level of scan signal $SD_2$ is high, capacitor 322 is again charged according to data signal DS. Transistor 323 outputs new driving current $I_2$ according to the voltage of capacitor 322. Since the logic level of scan signal $XSD_2$ is also high, light-emitting element 325 is illuminated.

The voltage of capacitor 322 in period $P_6$ depends on the data signal DS received by transistor 321 in period $P_2$. The voltage of capacitor 322 in period $P_7$ depends on the data signal DS received by transistor 321 in period $P_7$. Although light-emitting element 325 is illuminated in periods $P_6$ and $P_7$, if data signal DS in period $P_2$ is different than the data signal DS in period $P_7$, the brightness of light-emitting element 325 in period $P_6$ is different from the brightness of light-emitting element 325 in period $P_7$.

Taking pixel 31 as an example, since start signal STV only has a cycle in period $P_8$, the light-emitting state of light-emitting element 315 is luminous-dark-luminous in periods $P_1$~$P_4$. If transistor 314 is replaced by a PMOS transistor or the start signal cycle is inverted, the light-emitting state of light-emitting element 315 is changed to dark-luminous-dark in periods $P_1$~$P_4$. The light-emitting state of light-emitting element 315 is luminous-dark-luminous-dark-luminous as start signal STV has two cycles in period $P_8$.

Duration of each light-emitting state depends on the duty cycle of start signal STV. Assume a display panel requires 16.63 ms to display an image and the light-emitting states of all light-emitting elements in the display panel are luminous-dark-luminous. Then, if the duration of the luminous state is 16.63 ms, the brightness of the display panel is 100%, if the duration of the luminous state is 13.304 ms, the brightness of the display panel is 80%. If the duration of the luminous state is 8.315 ms, the brightness of the display panel is 50%.

For example, assume light-emitting element 315 is illuminated during periods $P_1$, $P_4$, and $P_5$ according to scan signal $XSD_1$. If the light-emitting duration (the duration of periods $P_1$, $P_4$, and $P_5$) of light-emitting element 315 is 13.304 ms, the brightness of the display panel is 50%. Therefore, the duty cycle of start signal STV controls the light-emitting duration of light-emitting element and thus controls the brightness of the display panel. Because of this, a user can adjust the brightness of the display panel according to actual requirements for reducing power consumption.

Figure 5:
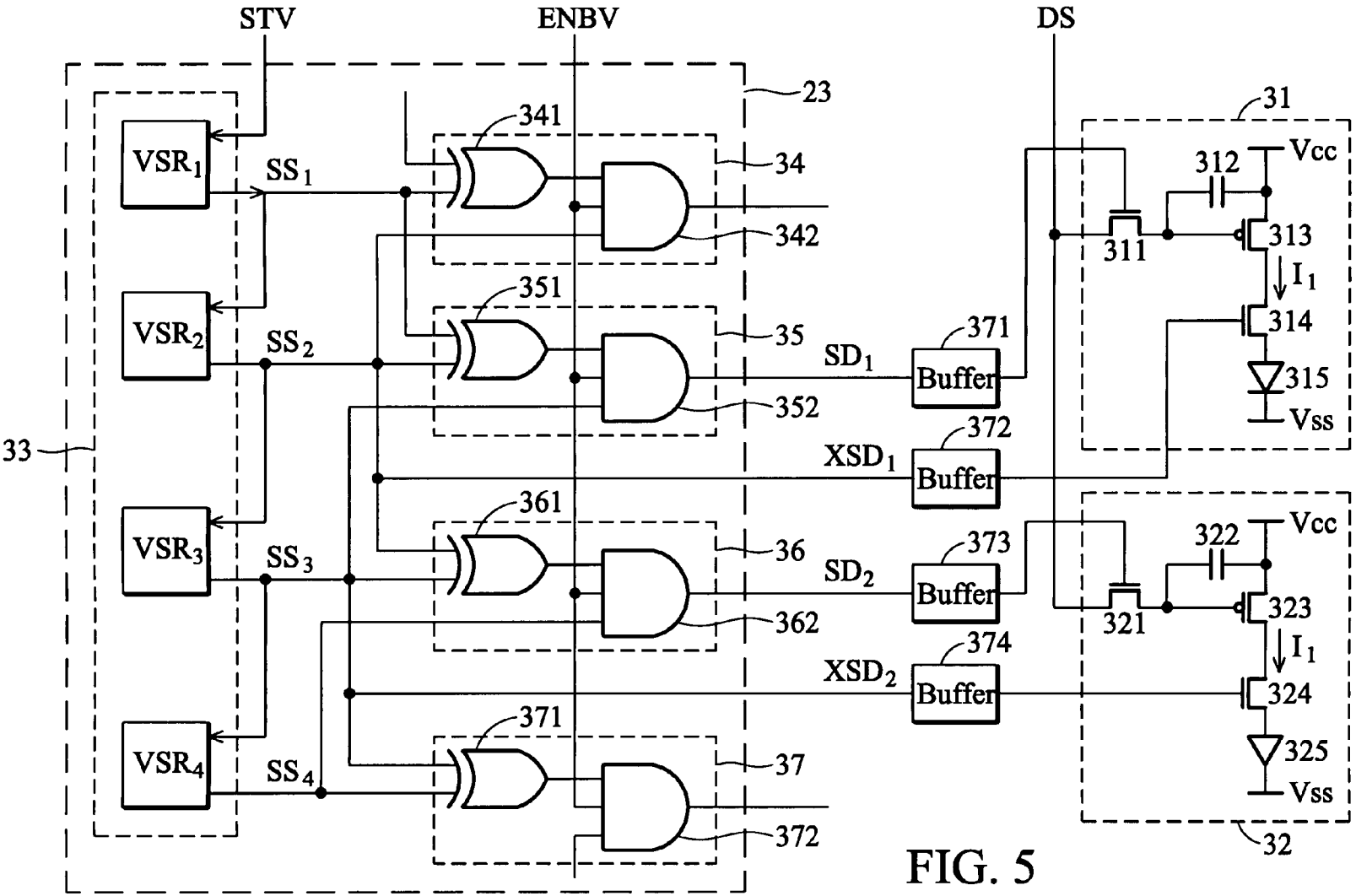
FIG. 5 is a schematic diagram of another embodiment of a scan driver.

FIG. 5 is a schematic diagram of another embodiment of a scan driver. Each of the logic units 342, 352, 362, and 372 further receives a vertical output enable signal ENBV. Each of the buffers 371~374 has an amplification function. Buffer 371 amplifies scan signal $SD_1$ for turning on transistor 311. Buffer 372 amplifies scan signal $XSD_1$ for turning on transistor 314. Buffer 373 amplifies scan signal $SD_2$ for turning on transistor 321. Buffer 374 amplifies scan signal $XSD_1$ for turning on transistor 321.

Figure 6:
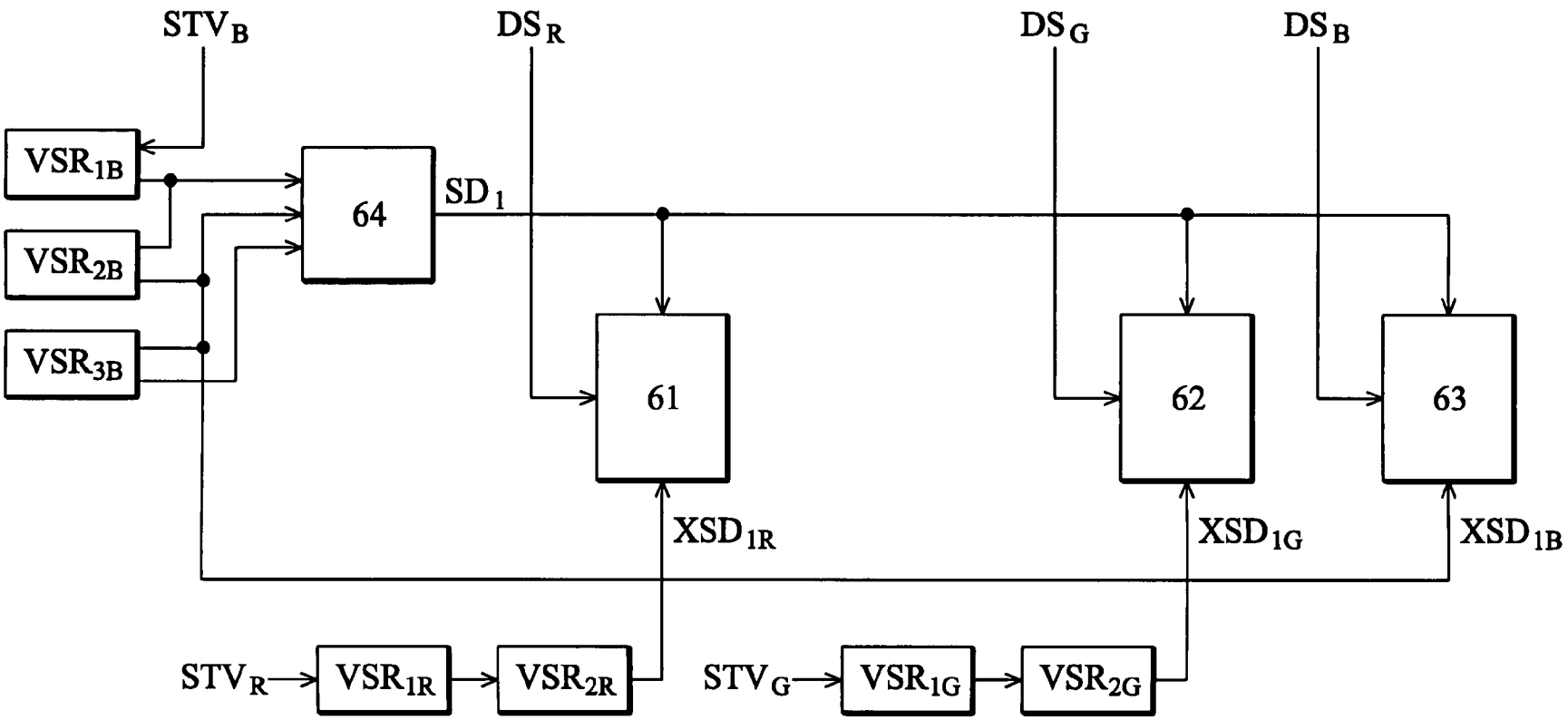
FIG. 6 is a schematic diagram of another embodiment of a scan driver.

FIG. 6 is a schematic diagram of another embodiment of a scan driver. Each pixel comprises three sub-pixels for displaying red, green and blue, respectively. For clarity, FIG. 6 only shows a pixel comprising sub-pixels 61~63 respectively displaying red, green and blue.

Each shift register unit $VSR_{1B}$~$VSR_{3B}$ provides a shift signal as shift register unit $VSR_{1B}$ receives start signal $STV_B$. Processor 64 receives shift signals provided by shift register units $VSR_{1B}$~$VSR_{3B}$ for generating scan signal $SD_1$. Sub-pixels 61~63 respectively receive data signals $DS_R$, $DS_G$ and $DS_B$ according to scan signal $SD_1$. A shift signal provided by shift register unit $VSR_{2B}$ is scan signal $XSD_{1B}$. Sub-pixel 63 is illuminated according to scan signal $XSD_{1B}$.

When shift register unit $VSR_{1R}$ receives start signal $STV_R$, a shift signal provided by shift register unit $VSR_{2R}$ is used as scan signal $XSD_{1R}$. Sub-pixel 61 is illuminated according to scan signal $XSD_{1R}$.

When shift register unit $VSR_{1G}$ receives start signal $STV_G$, a shift signal provided by shift register unit $VSR_{2G}$ is used as scan signal $XSD_{1G}$. Sub-pixels 62 is illuminated according to scan signal $XSD_{1G}$.

The light-emitting duration of sub-pixels 61~63 are respectively controlled by duty cycles of start signals $STV_R$, $STV_G$ and $STV_G$.

In summary, the light-emitting duration of the pixels of a display can be controlled by the duty cycle of start signal STV. The brightness of the display panel is brighter as the light-emitting duration of the pixels is longer, and vice versa. Therefore, a user can adjust the brightness of the display panel according to actual requirements.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A system for controlling a first pixel, the first pixel being operative to receive a first data signal, said system comprising:

a scan driver comprising:

a first shift-register unit operative to output a first shift signal according to a first start signal;

a second shift-register unit operative to output a second shift signal according to the first shift signal for lighting the first pixel;

a third shift-register unit operative to output a third shift signal according to the second shift signal; and a first processor operative to control the first pixel to receive the first data signal according to the first, the second, and the third shift signals, wherein the first processor comprises:

a first logic unit comprising a first input terminal operative to receive the first shift signal, a second input terminal operative to receive the second shift signal and a first output terminal, wherein the first output terminal outputs a first logic level when a logic level of the first shift signal equals that of the second shift signal and the first output terminal outputs a second logic level when the logic level of the first shift signal differs that of the second shift signal; and a second logic unit comprising a third input terminal coupled to the first output terminal, a fourth input terminal operative to receive the third shift signal, and a second output terminal coupled to the first pixel, wherein the second output terminal outputs the first logic level when the logic level of the first output terminal of the first logic unit or a logic level of the third shift signal equals the first logic level and the second output terminal outputs the second logic level when the logic level of the first output terminal of the first logic unit and the logic level of the third shift signal equal the second logic level;

wherein a duty cycle of the first start signal determines a light-emitting duration of the first pixel.

2. The system as claimed in claim 1, wherein the second logic unit further comprises a fifth input terminal operative to receive a control signal, the second output terminal outputs the first logic level when a logic level of the control signal or that of the third shift signal equals the first logic level, and the second output terminal outputs the second logic level when the logic level of the control signal and that of the third shift signal equal the first logic level.

3. The system as claimed in claim 1, further comprising:

a fourth shift register unit operative to output a fourth shift signal according to a second start signal;

a fifth shift register unit operative to output a fifth shift signal according to the fourth shift signal for lighting a second pixel;

a sixth shift register unit operative to output a sixth shift signal according to a third start signal;

a seventh shift register unit operative to output a seventh shift signal according to the sixth shift signal for lighting a third pixel;

wherein the first processor controls the first, the second, and the third pixels to receive the first, a second, and a third data signals according to the first, the second, and the third shift signals and controls the light-emitting duration of the first, the second, and the third pixels according to a duty cycle of the first, the second, and the third start signals, respectively.

4. The system as claimed in claim 3 wherein the first pixel displays a red color, the second pixel displays a blue color, and the third pixel displays a green color.

5. A system for controlling a pixel comprising:

a display device comprising:

a display panel comprising a first pixel;

a EL driver operative to output a start signal;

a data driver operative to output a first data signal to the first pixel; and a scan driver operative to output a first scan signal and a second scan signal to the first pixel, wherein the first pixel is operative to receive the first data signal according to the first scan signal and the first pixel is illuminated according to the second scan signal, the scan driver comprising:

a first shift-register unit operative to output a first shift signal according to the first start signal;

a second shift-register unit operative to output a second shift signal according to the first shift signal for lighting the first pixel;

a third shift-register unit operative to output a third shift signal according to the second shift signal; and a first processor operative to control the first pixel to receive the first data signal according to the first, the second, and the third shift signals, wherein the first processor comprises:

a first logic unit comprising a first input terminal operative to receive the first shift signal, a second input terminal is operative to receive the second shift signal and a first output terminal, wherein the first output terminal is operative to output a first logic level when a logic level of the first shift signal equals that of the second shift signal and the first output terminal is operative to output a second logic level when the logic level of the first shift signal differs that of the second shift signal; and a second logic unit comprising a third input terminal coupled to the first input terminal, a fourth input terminal operative to receive the third shift signal, and a second output terminal coupled to the first pixel, wherein the second output terminal is operative to output the first logic level when the logic level of the first output terminal of the first logic unit or a logic level of the third shift signal is the first logic level and the second output terminal is operative to output the second logic level when the logic level of the first output terminal of the first logic unit and the logic level of the third shift signal equal the second logic level;

wherein a duty cycle of the first start signal establishes a light-emitting duration of the first pixel.

6. The system as claimed in claim 5, wherein the second logic unit further comprises a fifth input terminal operative to receive a control signal, the second output terminal is operative to output the first logic level when a logic level of the control signal or that of the third shift signal equals the first logic level, and the second output terminal is operative to output the second logic level when the logic level of the control signal and that of the third shift signal equal the first logic level.

7. The system as claimed in claim 6, wherein the first logic unit is a XOR gate and the second logic unit is an AND gate.

8. The system as claimed in claim 7, wherein the display panel further comprises a second and a third pixel.

9. The system as claimed in claim 8, wherein the data driver further outputs a second and a third data signals.

10. The system as claimed in claim 9, wherein the scan driver further comprises:

a fourth shift register unit operative to output a fourth shift signal according to the second start signal;

a fifth shift register unit operative to output a fifth shift signal according to the fourth shift signal for lighting a second pixel;

a sixth shift register unit operative to output a sixth shift signal according to the third start signal; and a seventh shift register unit operative to output a seventh shift signal according to the sixth shift signal for lighting a third pixel; and wherein the first processor controls the first, the second, and the third pixels to receive the first, the second, and the third data signals according to the first, the second, and the third shift signals and controls the light-emitting durations of the first, the second, and the third pixels according to a duty cycle of the first, the second, and the third start signals, respectively.

11. The system as claimed in claim 10, wherein the first pixel displays a red color, the second pixel displays a blue color, and the third pixel displays a green color.

12. The system as claimed in claim 5, further comprising:

a digital-to-analog converter (DAC) operative to supply power to the display device.

13. The system as claimed in claim 5 further comprising:

means for supplying power to the display device.

14. The system as claimed in claim 5, wherein if the first data signal is different between a first time period and a second time period, brightness of the first pixel differs during a third time period and the second time period, wherein the first pixel is illuminated during the third time period and the second time period, wherein the third time period occurs after the first time period and the second time period follows the third time period.

15. The system as claimed in claim 14, wherein the display panel further comprises a second pixel, the data driver is operative to output a second data signal to the second pixel, the scan driver is operative to output a third scan signal and a fourth scan signal to the second pixel, the second pixel is operative to receive the second data signal according to the third scan signal and the first pixel is illuminated according to the fourth scan signal, wherein if the second data signal is different between a fourth time period and a fifth time period, brightness of the second pixel differs during a sixth time period and the fifth time period, wherein the second pixel is illuminated during the fifth time period and the sixth time period, wherein the sixth time period occurs after the fourth time period and the fifth time period follows the sixth time period, wherein the fourth time period follows the firth time period and the fifth time period follows the second time period, wherein the sixth time period overlaps the third time period and the first pixel is extinguished during the fourth time period.

* * * * *